US009975664B2

(12) United States Patent
Fath

(10) Patent No.: US 9,975,664 B2
(45) Date of Patent: May 22, 2018

(54) DISPLAY PACKAGE

(71) Applicant: Scott A. Fath, Richmond, VA (US)

(72) Inventor: Scott A. Fath, Richmond, VA (US)

(73) Assignee: ALTRIA CLIENT SERVICES LLC, Richmond, VA (US)

( * ) Notice: Subject to any disclaimer, the term of this patent is extended or adjusted under 35 U.S.C. 154(b) by 0 days. days.

(21) Appl. No.: 14/872,786

(22) Filed: Oct. 1, 2015

(65) Prior Publication Data

US 2016/0096658 A1 Apr. 7, 2016

Related U.S. Application Data

(60) Provisional application No. 62/058,877, filed on Oct. 2, 2014.

(51) Int. Cl.
*B65D 25/54* (2006.01)
*B31B 1/90* (2006.01)
(Continued)

(52) U.S. Cl.
CPC ..... *B65D 25/54* (2013.01); *A24F 47/002* (2013.01); *B31B 50/81* (2017.08); *B65B 5/024* (2013.01);
(Continued)

(58) Field of Classification Search
CPC ..... A24F 15/12; A24F 47/002; B65D 5/3607; B65D 5/4204; B65D 5/48014;
(Continued)

(56) References Cited

U.S. PATENT DOCUMENTS

D117,986 S 12/1939 Weiss
2,354,239 A 7/1944 Williamson
(Continued)

FOREIGN PATENT DOCUMENTS

DE 4339645 A1 5/1995
EP 0465257 A1 1/1992
(Continued)

OTHER PUBLICATIONS

International Search Report and Written Opinion from corresponding International Application PCT/US2015/053518, dated Feb. 2, 2016.

(Continued)

*Primary Examiner* — Chun Cheung
(74) *Attorney, Agent, or Firm* — Harness, Dickey & Pierce, P.L.C.

(57) ABSTRACT

A method of displaying an article, a package configured to display a selected portion of an article, and a blank for forming a rectangular box, which is configured to contain an elongate body are disclosed. The method includes establishing a box structure having an inner cavity and a side portion; dividing the side portion into a lower retention portion, and upper retention portion, and a window recess portion, the dividing including: establishing a side recess panel at a location along a side panel of the box structure; establishing a front recess panel along a front panel of the box structure, the front recess panel adjacent the side recess panel, the front recess panel having a greater width than the side recess panel; and establishing the window recess portion by folding the first and front recess panels into the box structure.

20 Claims, 10 Drawing Sheets

(51) Int. Cl.

| | |
|---|---|
| ***B65B 5/02*** | (2006.01) |
| ***A24F 47/00*** | (2006.01) |
| ***B65D 5/42*** | (2006.01) |
| ***B65D 5/489*** | (2006.01) |
| ***B65D 5/50*** | (2006.01) |
| ***B65D 85/20*** | (2006.01) |
| ***B31B 50/81*** | (2017.01) |

(52) U.S. Cl.
CPC ..... *B65D 5/4204* (2013.01); *B65D 5/4802* (2013.01); *B65D 5/5007* (2013.01); *B65D 85/20* (2013.01); *B31B 2241/00* (2013.01)

(58) Field of Classification Search
CPC .. B65D 5/5007; B65D 5/50016; B31B 50/81; B65B 50/81
USPC ..... 206/1.5, 528–540
See application file for complete search history.

(56) References Cited

U.S. PATENT DOCUMENTS

| | | | | |
|---|---|---|---|---|
| D147,120 | S | 7/1947 | Dietrich | |
| 2,464,951 | A | 3/1949 | Stengren | |
| 2,611,529 | A | 9/1952 | Currivan | |
| 2,727,620 | A | 12/1955 | Buttery | |
| 2,948,390 | A | 8/1960 | Wagaman | |
| 2,980,242 | A | 4/1961 | Miller | |
| D190,772 | S | 6/1961 | Cuyler | |
| 3,029,934 | A | 4/1962 | Hennessey | |
| 3,033,357 | A | 5/1962 | Brown | |
| 3,206,098 | A | 9/1965 | Stenger et al. | |
| 3,233,726 | A * | 2/1966 | Gero | B65D 5/4204 229/120.15 |
| 3,326,444 | A | 6/1967 | Farquhar | |
| D218,212 | S | 7/1970 | Pfrommer | |
| 3,767,037 | A * | 10/1973 | Anderson | B65D 5/02 206/497 |
| 3,828,923 | A * | 8/1974 | Phillips, Jr. | B65D 5/6688 206/254 |
| 4,106,615 | A * | 8/1978 | Hiroshi | B65D 5/4208 206/362.2 |
| 4,125,185 | A | 11/1978 | Bliss | |
| 4,342,417 | A * | 8/1982 | Forbes, Jr. | B65D 5/48014 229/120.08 |
| 4,353,694 | A | 10/1982 | Pelerin | |
| 4,487,311 | A * | 12/1984 | Lavery | B65D 5/48014 206/499 |
| 4,524,871 | A | 6/1985 | Klinger | |
| D290,175 | S | 6/1987 | Bakic | |
| 4,848,563 | A | 7/1989 | Robbins | |
| 4,865,204 | A | 9/1989 | Vance | |
| D314,146 | S | 1/1991 | Scholz | |
| 5,044,548 | A | 9/1991 | Olsen et al. | |
| 5,226,534 | A | 7/1993 | Kim | |
| D353,712 | S | 12/1994 | Aalders | |
| 5,848,690 | A | 12/1998 | Granger et al. | |
| 5,944,183 | A * | 8/1999 | Rowland | B65D 5/48024 206/232 |
| 6,050,416 | A | 4/2000 | Blin et al. | |
| 6,244,501 | B1 | 6/2001 | Choi | |
| 6,460,703 | B1 | 10/2002 | Thompson et al. | |
| D466,406 | S | 12/2002 | Solland | |
| 6,491,211 | B1 | 12/2002 | Evans et al. | |
| D546,669 | S | 7/2007 | Sheppard et al. | |
| D563,218 | S | 3/2008 | DeMalsche et al. | |
| D576,871 | S | 9/2008 | Sheppard et al. | |
| D577,286 | S | 9/2008 | Sheppard et al. | |
| 7,424,955 | B2 | 9/2008 | Chen | |
| D588,449 | S | 3/2009 | Bova et al. | |
| D601,009 | S | 9/2009 | Shinn | |
| D602,637 | S | 10/2009 | Helenowski | |
| D654,786 | S | 2/2012 | Rye et al. | |
| 8,191,707 | B2 | 6/2012 | McDonald et al. | |
| D699,103 | S | 2/2014 | Rathbone et al. | |
| D699,562 | S | 2/2014 | Klauder | |
| D700,049 | S | 2/2014 | Athay | |
| D702,546 | S | 4/2014 | McAdam | |
| D710,713 | S | 8/2014 | Fath | |
| D732,384 | S | 6/2015 | Fath | |
| D734,145 | S | 7/2015 | Fath et al. | |
| D735,572 | S | 8/2015 | Fath et al. | |
| D743,248 | S | 11/2015 | Fath et al. | |
| D746,699 | S | 1/2016 | Fath | |
| D746,700 | S | 1/2016 | Boehnen et al. | |
| D756,780 | S | 5/2016 | Grove et al. | |
| D756,781 | S | 5/2016 | Grove et al. | |
| 2005/0236282 | A1 | 10/2005 | Huska | |
| 2011/0297559 | A1* | 12/2011 | Davis | B65B 25/008 206/5.1 |
| 2012/0061290 | A1 | 3/2012 | Delaunay et al. | |
| 2012/0227753 | A1 | 9/2012 | Newton | |
| 2013/0140200 | A1 | 6/2013 | Scatterday | |
| 2013/0342157 | A1 | 12/2013 | Liu | |
| 2014/0097103 | A1* | 4/2014 | Cameron | A24F 47/008 206/38 |
| 2014/0262871 | A1 | 9/2014 | Fath | |
| 2015/0342252 | A1 | 12/2015 | Fath | |
| 2016/0096658 | A1 | 4/2016 | Fath | |

FOREIGN PATENT DOCUMENTS

| | | | |
|---|---|---|---|
| EP | 1818266 | A1 | 8/2007 |
| RU | 46078 | S | 9/1999 |
| RU | 63280 | S | 7/2007 |

OTHER PUBLICATIONS

Website http://alloy.ru (Dec. 24, 2012).
Written Opinion by the International Searching Authority in corresponding International Application PCT/US2014/022719, dated Jun. 12, 2014.
International Search Report and Written Opinion from corresponding International Application PCT/US2015/033253, dated Oct. 21, 2015.
Notification of Transmittal of International Preliminary Report on Patentability issued in corresponding International Application No. PCT/US2014/022719, dated Sep. 24, 2015.
Notification Concerning Transmittal of International Preliminary Report on Patentability and International Report on Patentability in related International Application PCT/US2015/033253, dated Dec. 8, 2016.
HackYa, Philip Morris' Mark 10 Review, Apr. 24, 2014 [earliest online date], [site visited Oct. 19, 2016], Available from internet, <url:http://hackya.com/us/philip-morris-mark-ten-review>.
U.S. Office Action dated Aug. 24, 2017 in related U.S. Appl. No. 29/546,678.
U.S. Office Action dated Aug. 31, 2017 in related U.S. Appl. No. 13/843,314.
Office Action dated Mar. 22, 2017 in related U.S. Appl. No. 13/843,314.
Office Action dated Mar. 9, 2017 in related U.S. Appl. No. 29/541,752.
Final Office Action dated Mar. 30, 2017 in related U.S. Appl. No. 14/725,556.
International Preliminary Report on Patentability dated Apr. 4, 2017, in related PCT/US2015/053518.
U.S. Office Action dated May 26, 2017 in related U.S. Appl. No. 14/725,556.
Office Action for corresponding Chinese Application No. 201480024117.3 dated Oct. 17, 2017 and English translation thereof.
U.S. Office Action dated Nov. 8, 2017 in related U.S. Appl. No. 14/725,556.
European Examination Report dated Jan. 12, 2018 in European Application No. 15 756 501.1.
U.S. Office Action dated Mar. 15, 2018 in related U.S. Appl. No. 13/843,314.

(56) References Cited

OTHER PUBLICATIONS

Russian Search Report dated Feb. 26, 2018 in Russian Application No. 2015144319/12(068246), with an English translation.
Russian Decision to Grant dated Feb. 28, 2018 in Russian Application No. 2015144319/12(068246).

* cited by examiner

DISPLAY PACKAGE

PRIORITY STATEMENT

This application is a non-provisional application that claims priority to U.S. provisional app. No. 62/058,877, filed on Oct. 2, 2014, the entire content of which is incorporated by reference in its entirety.

BACKGROUND

Field

Electronic vaping devices may be sold and displayed in packages.

Description of Related Art

Electronic vaping devices may emulate cigarettes, but without the combustion of tobacco. Rather than burning tobacco, a vapor precursor is vaporized.

A packing concept particularly suited for the packaging of electronic vaping devices is disclosed in commonly assigned U.S. Patent Application Publication No. 2014/0262871, the content of which is incorporated herein by reference in its entirety.

SUMMARY

In accordance with some example embodiments, a method of displaying an article is disclosed, the method comprises: establishing a box structure having a side portion; dividing the side portion into a lower retention portion, and upper retention portion, and a window recess portion, the recess portion disposed between the upper and lower retention portions; the dividing including: establishing a side recess panel at a location along a side panel of the box structure; establishing a front recess panel along a front panel of the box structure, the front recess panel adjacent the side recess panel, the front recess panel having a greater width than the side recess panel such that the window recess portion has a greater depth than width; and establishing the window recess portion by folding the side and front recess panels into the box structure; whereby the window recess portion, the upper retention portion and the lower retention portion are mutually arranged to retain the article along the side portion, with a portion of the article displayed along the recess portion.

In accordance with some example embodiments, a package configured to display a selected portion of an article is disclosed, the package comprises: a box structure having a side portion, the side portion divided into a lower retention portion, and upper retention portion, and a window recess portion, the recess portion disposed between the upper and lower retention portions; the recess portion comprising a side recess panel at a location along a side panel of the box structure and a front recess panel along a front panel of the box structure, the front recess panel adjacent the side recess panel, the front recess panel having a greater width than the side recess panel such that the window recess portion has a greater depth than width, and wherein the first and front recess panels being folded into the box structure; and whereby the window recess portion, the upper retention portion and the lower retention portion are mutually arranged to retain the article along the side portion, with a portion of the article being displayed along the recess portion.

In accordance with some example embodiments, a blank for forming a rectangular box is disclosed, which is configured to contain an elongate body, the blank comprises: a side panel connected to a front panel along a first fold line, the first fold line extending along a first side edge of the front panel; a cavity side panel connected to the front panel along a second fold line, the second fold line extending along a second side edge of the front panel; a back panel connected to the cavity side panel along a third fold line, the third fold line extending along a first side edge of the back panel; a first glue panel connected to the back panel along a fourth fold line, the fourth fold line extending along a second side edge of the back panel; a first upper dust panel connected to the side panel along a top edge of the side panel; a first lower dust panel connected to the side panel along a lower edge of the side panel; a top panel connected to the front panel along a fifth fold line, the fifth fold line extending along a top edge of the front panel, the top panel having a upper flap panel and an end panel, and wherein the upper flap panel is connected to the end panel along a sixth fold line; a second upper dust panel connected to the cavity side panel along a top edge of the cavity side panel; a second lower dust panel connected to the cavity side panel along a lower edge of the cavity side panel; a bottom panel connected to the front panel along a seventh fold line, the seventh fold line extending along a bottom edge of the front panel; a second glue panel connected to the back panel along an eighth fold line, the eighth fold line extending along a bottom edge of the back panel; and an upper and a lower cut line extending across an upper and a lower portion of the front panel adjacent to the cavity side panel and extending across the cavity side panel, respectively, and which forms a first cavity panel and a second cavity panel, the first cavity panel having a greater width than the second cavity panel, and wherein upon assembly of the rectangular box, the first cavity panel and the second cavity panel are perpendicular to the front panel and the cavity side panel, respectively, forming a cavity having a greater depth than width, which is configured to receive the elongate body.

In accordance with some example embodiments, a blank for forming a rectangular box is disclosed, which is configured to contain an elongate body, the blank comprises: a side panel connected to a front panel along a first fold line, the first fold line extending along a first side edge of the front panel; a cavity side panel connected to the front panel along a second fold line, the second fold line extending along a second side edge of the front panel; a back panel connected to the cavity side panel along a third fold line, the third fold line extending along a first side edge of the back panel; a first glue panel connected to the back panel along a fourth fold line, the fourth fold line extending along a second side edge of the back panel; a top panel connected to the front panel along a fifth fold line, the fifth fold line extending along a top edge of the front panel; a bottom panel connected to the front panel along a seventh fold line, the seventh fold line extending along a bottom edge of the front panel; a second glue panel connected to the back panel along an eighth fold line, the eighth fold line extending along a bottom edge of the back panel; a first upper dust panel connected to the side panel along a top edge of the side panel; a third glue panel connected to the back panel along an eleventh fold line, which extends along an upper edge of the back panel; and an upper and a lower cut line extending across an upper and a lower portion of the front panel adjacent to the cavity side panel and extending across the cavity side panel, respectively, and which forms a first cavity panel and a second cavity panel, the first cavity panel having a greater width than the second cavity panel, and wherein upon assembly of the rectangular box, the first cavity panel and the second cavity panel are perpendicular to the front panel and the cavity side panel, respectively, forming a cavity having a greater depth than width, which is configured to receive the elongate body.

A method of packaging an elongate body is disclosed, the method comprises: partially erecting a box from a blank so as to have an opening at a bottom of the box and an opening at a top of the box, the blank comprising: a side panel connected to a front panel along a first fold line, the first fold line extending along a first side edge of the front panel; a cavity side panel connected to the front panel along a second fold line, the second fold line extending along a second side edge of the front panel; a back panel connected to the cavity side panel along a third fold line, the third fold line extending along a first side edge of the back panel; a first glue panel connected to the back panel along a fourth fold line, the fourth fold line extending along a second side edge of the back panel; and an upper and a lower cut line extending across an upper and a lower portion of the front panel adjacent to the cavity side panel and extending across the cavity side panel, respectively, and which forms a first cavity panel and a second cavity panel, the first cavity panel having a greater width than the second cavity panel such that a window recess portion formed by the first cavity panel and the second cavity panel has a greater depth than width; pre-folding the blank along the second fold line and the forth fold line; folding the blank along the first fold line and the third fold line, so that the side panel and the first glue panel overlap; applying glue to one or more of a back side of the cavity side panel or a backside side of the back panel and adhering the cavity side panel to the back panel; and applying glue to one or more of the side panel and the first glue panel to adhere the side panel and the first glue panel together.

BRIEF DESCRIPTION OF THE DRAWINGS

The various features and advantages of the non-limiting embodiments herein may become more apparent upon review of the detailed description in conjunction with the accompanying drawings. The accompanying drawings are merely provided for illustrative purposes and should not be interpreted to limit the scope of the claims. The accompanying drawings are not to be considered as drawn to scale unless explicitly noted. For purposes of clarity, various dimensions of the drawings may have been exaggerated.

DETAILED DESCRIPTION

Figure 1:
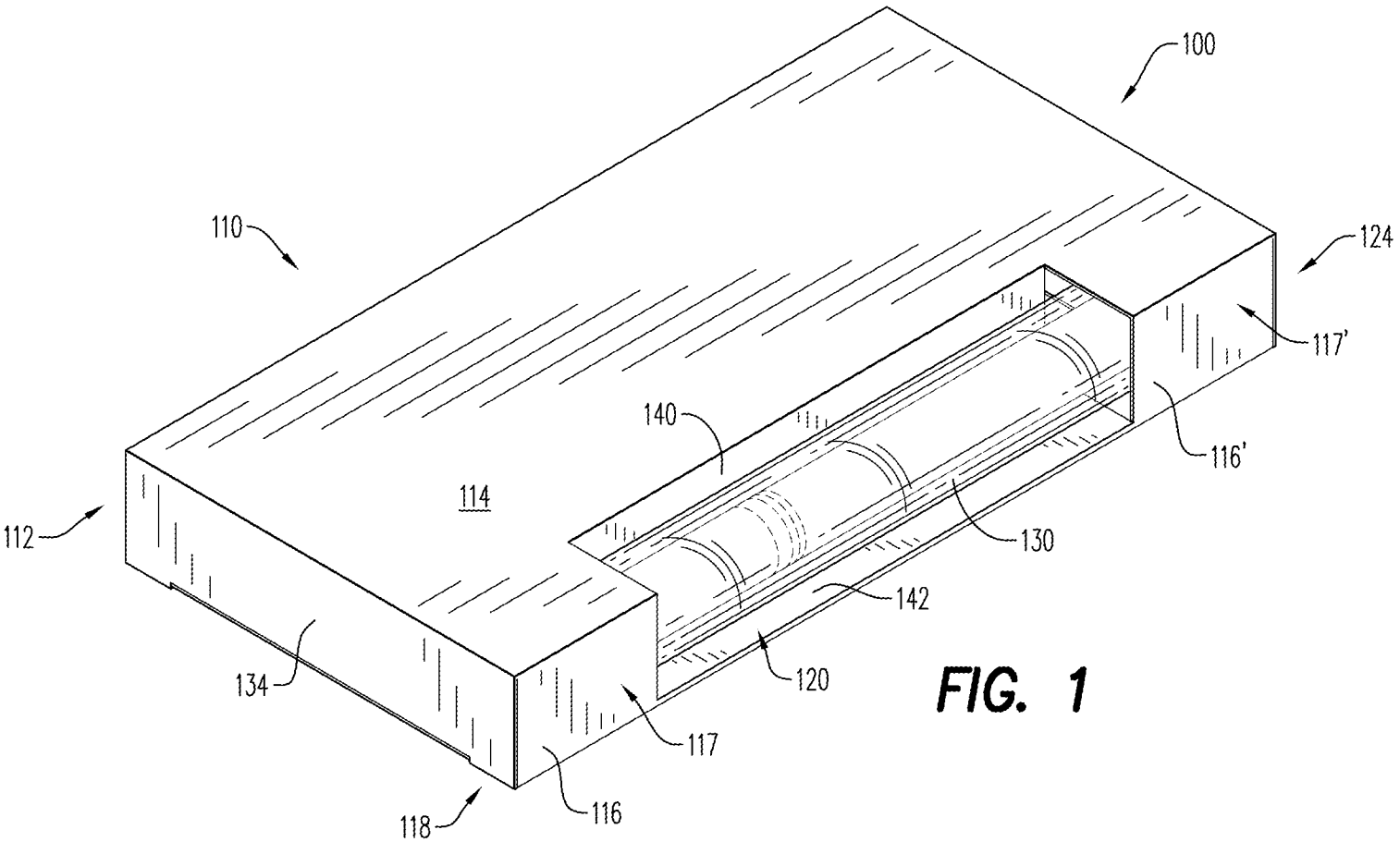
FIG. 1 is a perspective view of an electronic vaping device package in accordance with some example embodiments.

Some detailed example embodiments are disclosed herein. However, specific structural and functional details disclosed herein are merely representative for purposes of describing example embodiments. Example embodiments may, however, be embodied in many alternate forms and should not be construed as limited to only the example embodiments set forth herein.

Accordingly, while example embodiments are capable of various modifications and alternative forms, example embodiments thereof are shown by way of example in the drawings and will herein be described in detail. It should be understood, however, that there is no intent to limit example embodiments to the particular forms disclosed, but to the contrary, example embodiments are to cover all modifications, equivalents, and alternatives falling within the scope of example embodiments. Like numbers refer to like elements throughout the description of the figures.

It should be understood that when an element or layer is referred to as being "on," "connected to," "coupled to," or "covering" another element or layer, it may be directly on, connected to, coupled to, or covering the other element or layer or intervening elements or layers may be present. In contrast, when an element is referred to as being "directly on," "directly connected to," or "directly coupled to" another element or layer, there are no intervening elements or layers present. Like numbers refer to like elements throughout the specification. As used herein, the term "and/or" includes any and all combinations of one or more of the associated listed items.

It should be understood that, although the terms first, second, third, etc. may be used herein to describe various elements, components, regions, layers and/or sections, these elements, components, regions, layers, and/or sections should not be limited by these terms. These terms are only used to distinguish one element, component, region, layer, or section from another region, layer, or section. Thus, a first element, component, region, layer, or section discussed below could be termed a second element, component, region, layer, or section without departing from the teachings of example embodiments.

Spatially relative terms (e.g., "beneath," "below," "lower," "above," "upper," and the like) may be used herein for ease of description to describe one element or feature's relationship to another element(s) or feature(s) as illustrated in the figures. It should be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" may encompass both an orientation of above and below. The device may be otherwise oriented (rotated 90 degrees or at other orientations) and the spatially relative descriptors used herein interpreted accordingly.

The terminology used herein is for the purpose of describing various embodiments only and is not intended to be limiting of example embodiments. As used herein, the singular forms "a," "an," and "the" are intended to include the plural forms as well, unless the context clearly indicates otherwise. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

Example embodiments are described herein with reference to cross-sectional illustrations that are schematic illustrations of idealized embodiments (and intermediate structures) of example embodiments. As such, variations from the shapes of the illustrations as a result, for example, of manufacturing techniques and/or tolerances, are to be expected. Thus, example embodiments should not be construed as limited to the shapes of regions illustrated herein but are to include deviations in shapes that result, for example, from manufacturing. The regions illustrated in the figures are schematic in nature and their shapes are not intended to illustrate the actual shape of a region of a device and are not intended to limit the scope of example embodiments.

Moreover, when the words "generally" and "substantially" are used in connection with geometric shapes, it is intended that precision of the geometric shape is not required but that latitude for the shape is within the scope of the disclosure. When used with geometric terms, the words "generally" and "substantially" are intended to encompass not only features which meet the strict definitions but also features which fairly approximate the strict definitions.

Unless otherwise defined, all terms (including technical and scientific terms) used herein have the same meaning as commonly understood by one of ordinary skill in the art to which example embodiments belong. It will be further understood that terms, including those defined in commonly used dictionaries, should be interpreted as having a meaning that is consistent with their meaning in the context of the relevant art and will not be interpreted in an idealized or overly formal sense unless expressly so defined herein.

When the word "about" is used in this specification in connection with a numerical value, it is intended that the associated numerical value include a tolerance of ±10% around the stated numerical value. Moreover, when reference is made to percentages in this specification, it is intended that those percentages are based on weight, i.e., weight percentages.

In accordance with some example embodiments, a blank 200, 500, 1000, 1100 (FIGS. 2, 5, 10, and 11) for forming a display package (or box) 100 (FIG. 1) configured to contain at least one article such as an electronic vaping device is disclosed. The at least one electronic vaping device may be held securely within an elongated hollow cylinder or tube within a view recess or side edge cavity 120 along an outer side edge portion of the package 100, such that the electronic vaping device is visible to a purchaser and/or consumer.

FIG. 1 is a perspective view of an electronic vaping device package 100 in accordance with some example embodiments. As shown in FIG. 1, the electronic vaping device package 100 includes a rectangular box portion 110, which is a substantially rectangular parallelepipedal shaped box, with right-angled longitudinal and right-angled transverse edges. The rectangular box portion 110 includes an inner cavity 122 (FIGS. 3, 4, 6, 8, and 12) and a viewing window or side cavity 120, which is configured to receive an encased electronic vaping device (not shown). In accordance with some example embodiments, the viewing window or side cavity 120 has a greater depth than width.

In accordance with some example embodiments, the electronic vaping device is encased in a transparent/translucent, tubular or elongated hollow cylinder (or body) 130, which is configured to fit within the viewing window or side cavity 120 of the box portion 110 of the electronic vaping device package 100. In accordance with some example embodiments, the tubular or elongated hollow cylinder 130 is a transparent hollow cylinder having at least one removable cap or lid on one end and a closed or non-removable cap or end on the opposite end. In some example embodiments, the elongated hollow cylinder 130 may be a clear glass or plastic tube.

In accordance with some example embodiments, the rectangular box portion 110 includes a side panel 112, a front panel 114, a partial side panel 116, a back panel 118, a top panel 124, and a bottom panel 134. The viewing recess 120 within the rectangular box portion 110 is formed by folding inwardly a front recess panel 140 located along an outer edge or portion of a front panel 114 and a side recess panel 142 located along the side panel 116 of the rectangular box portion 110. When folded, the recess panels 140, 142 are about 90 degrees (or perpendicular) to the front panel 114 and the cavity side panel 116, respectively. By appearances, the side panel 116 comprises an upper side panel portion 116 and a lower side panel portion 116', which are collectively referenced as side panel 116.

In accordance with some example embodiments, the window or viewing cavity 120 extends a distance less than a height of the front panel 112 to establish retention portions 117, 117', which retain the end portions of elongated hollow cylinder 130 within box 110, with portion of the cylinder 130 viewable along the cavity 120. For example, in accordance with some example embodiments, the length of the side edge cavity 120 is less than the length of the hollow cylinder 130. In addition, the length of the hollow cylinder 130 may be substantially the same as the length of the front panel 114 so as to limit up-and-down movement of the cylinder (tube) 130 In addition, the ends (not shown) of the hollow cylinder 130 may be covered by the retention portions 117, 117' of the box 100.

Figure 2:
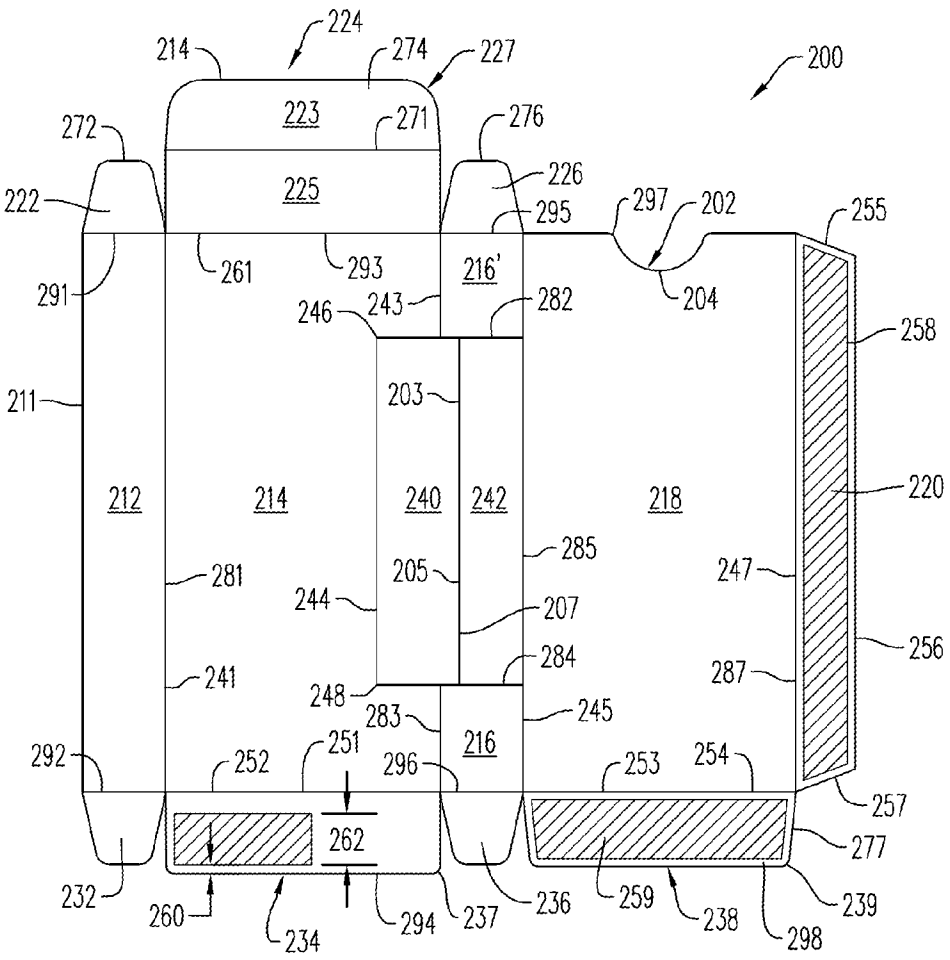
FIG. 2 is a blank for forming an electronic vaping device package in accordance with some example embodiments.

In accordance with some example embodiments, a blank 200 for forming a rectangular box 110 having a cavity 120, which is configured to contain a hollow elongated cylinder 130 is shown in FIG. 2. The blank 200 includes a first complete side panel 212 connected to a front panel 214 along a first fold line 241. The first fold line 241 extends along a first side edge 281 of the front panel 214. Upper and lower cavity side panel portions, 216, 216' (collectively cavity side panel 216) are connected to the front panel 214 along a second fold line 243. The second fold line 243 extends along a second side edge 283 of the front panel 214. A back panel 218 is connected to the cavity side panel 216 along a third fold line 245. The third fold line 245 extends along a first side edge 285 of the back panel 218. A first glue panel 220 connects to the back panel 218 along a fourth fold line 247. The fourth fold line 247 extends along a second side edge 287 of the back panel 218.

The blank 200 also includes a first upper dust panel 222 connected to the side panel 212 along a top edge 291 of the side panel 212, and a first lower dust panel 232 connected to the side panel 212 along a lower edge 292 of the side panel 212. A top panel 224 is connected to the front panel 214 along a fifth fold line 261. The fifth fold line 261 extends along a top edge 293 of the front panel 214. In accordance with some example embodiments, the top panel 224 has an upper flap panel (or tuck panel) 223 and an end (top) panel 225. The upper flap panel or tuck panel 223 is connected to the end panel 225 along a sixth fold line 271. An outer bottom panel 234 is connected to the front panel 214 along a seventh fold line 251. The seventh fold line 251 extends along a bottom edge 252 of the front panel 214. A second upper dust panel 226 is connected to the cavity side panel 216 along a top edge 295 of the cavity side panel 216, and a second lower dust panel 236 is connected to the cavity side panel 216 along a bottom edge 296 of the cavity side panel 216. In accordance with some example embodiments, a second (inner) glue panel 238 is connected to the back panel 218 along an eighth fold line 253. The eighth fold line 253 extends along a bottom edge 254 of the back panel 218.

The blank 200 also includes an upper cut line 282 and a lower cut line 284 extending transversely across an upper and a lower portion of the front panel 214 adjacent to the upper and lower side panel portions 216, 216' and extending across the cavity side panel 216, respectively. The upper cut line 282 and the lower cut line 284 form a first cavity panel 240 and a second cavity panel 242 within the front panel 214 and between the side panel portions 216, 216', respectively. A ninth (scored) fold line 244 extends between an inner edge 246 of the upper cut line 282 and an inner edge 248 of the lower cut line 284 on the front panel 214. A tenth (scored) fold line 203 extends between the upper cut line 282 and the lower cut line 284 forming an outer edge 205 of the first cavity panel 240 and an inner edge 207 of the second cavity panel 242.

In accordance with some example embodiments, upon assembly of the box 110, the first cavity panel 240 and the second cavity panel 242 are positioned perpendicular to the front panel 214 and the cavity side panel 216, respectively. Panels 240, 242 form the viewing window or side cavity 120. In accordance with some example embodiments, the cavity 120 receives the elongated hollow cylinder 130. In accordance with some example embodiments, the upper and lower cut lines 282, 284 extend across the front panel 214 a distance equal to a combined width of the front recess panel 140 and cavity side panel 142.

In accordance with some example embodiments, the side panel 212 has a vertical free edge 211. In addition, each of the first and second dust panels 222, 226 has an outer edge 272, 276. The top panel 224, the bottom panel 234, and the second glue panel 238, each have a free outer edge 274, 294, 298. The back panel 218 includes a recessed portion 202 within an upper edge 297 of the back panel 218, which provides assistance and/or access for a consumer to contents enclosed within the box 110 such as an information booklet and/or coupon 150 (shown in FIG. 4), which may be stored within the box portion 110 of the electronic vaping device package 100.

Figure 11:
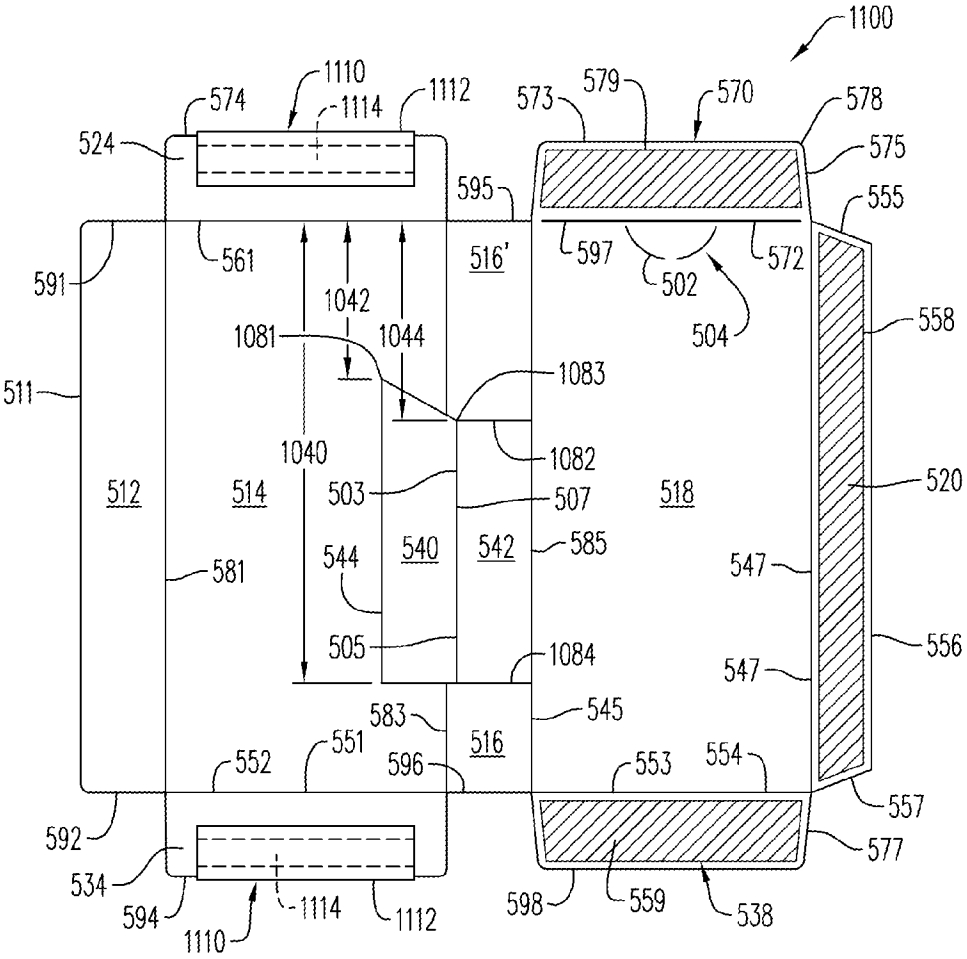
FIG. 11 is a blank for forming an electronic vaping device package in accordance with some example embodiments.

The blank 200 may include a finish or varnish on the clay (printable) side of the blank 200. In accordance with some example embodiments, the first glue panel 220, bottom panel 234, and the second glue panel 238 may each include a varnish free area or portion 258, 260, 259, respectively, which may improve the bonding formed by the glue, for example, a hot-melt adhesive material, and/or adhesive or pressure sensitive tape 1110 (FIG. 11). In accordance with some example embodiments, the first glue panel 220 has a pair of angled edges 255, 257, which are slightly tapered to a vertical free edge 256. For example, in accordance with some example embodiments, the varnish free areas 258, 259 of the first glue and second glue panel 220, 238 may cover the entire panels 220 or a portion thereof.

In accordance with some example embodiments, the varnish free area 260 of the bottom panel 234 may include a date code area 262. The date code area 262 may have a width of about 25 mm to about 30 mm, for example, 28 mm, and a height of about 8 mm to about 12 mm, for example, about 10 mm. In accordance with some example embodiments, the date code area 262 may be positioned about 1.0 mm to about 2.0 mm, for example, about 1.5 mm from a left (or right) vertical edge of the bottom panel 234, and about 1.0 to about 2.0 mm, for example, about 1.5 mm from the lower free edge 294 of the bottom panel 234.

In accordance with some example embodiments, the side panel 212 may have a width of about 15 mm to about 18 mm, for example, about 16.6 mm, and a height of about 105 mm to about 115 mm, for example, about 109 mm. The front panel 214 may have a width of about 50 mm to about 60 mm, for example, about 55 mm, and a height of about 105 mm to about 115 mm, for example, about 110 mm. The cavity side panel 216 (portions 216, 216') may have a width of about 15 mm to about 18 mm, for example, about 17.0 mm and a height of about 105 mm to about 115 mm, for example, about 109 mm. The back panel 218 may have a width of about 50 mm to about 60 mm, for example, about 54.6 mm and a height of about 105 mm to about 115 mm, for example, about 109 mm. The first glue panel 220 may have a width of about 10 mm to about 12 mm, for example, about 11.0 mm, and a height of about 105 mm to about 115 mm, for example, about 109 mm.

In accordance with some example embodiments, the first cavity panel 240 may have a height of about 65 mm to about 75 mm, for example, about 69 mm, and a width of about 15 mm to about 18 mm, for example, about 16.5 mm. The second cavity panel 242 may have a height of about 65 mm to about 75 mm, for example, about 69 mm, and a width of about 12 mm to about 14 mm, for example, about 13.0 mm. Thus, upon assembly of the package 100, the depth (e.g., about 16.5 mm) of the viewing window or side cavity 120 is greater than a width (13.0 mm) of the viewing window or side cavity 120. In accordance with some example embodiments, a distance from the cut lines 282, 284 to the upper edges 293, 295 of the front panel 214 and the cavity side panel 216, and the lower edges 252, 296 of the front panel 214 and the cavity side panel 216 is about 20.5 mm.

In accordance with some example embodiments, the first upper dust panel 222 and the first lower dust panel 232 may each have a width of about 15 mm to about 18 mm, for example, about 16.6 mm, and a height of about 14 mm to about 16 mm, for example about 15.0 mm. The upper flap panel or tuck panel 223 may have a width of about 50 mm to about 60 mm, for example, about 55 mm, and a height of about 13 mm to about 15 mm, for example, about 14.0 mm. In accordance with some example embodiments, the corners of the tuck panel 223 may be rounded 227. The end panel 225 may have a width of about 50 mm to about 60 mm, for example, about 55 mm, and a height of about 15 mm to about 18 mm, for example, about 16.5 mm. The second upper dust panel 226 and the second lower dust panel 236, each may have a width of about 16 mm to about 18 mm, for example, about 17.0 mm, and a height of about 14 mm to about 17 mm, for example, about 15.5 mm. The bottom panel 234 may have a width of about 50 mm to about 60 mm, for example, about 55 mm, and a height of about 15 mm to about 18 mm, for example, about 16.0 mm. In accordance with some example embodiments, the corners 237 of the bottom panel (or end panel) 234 may be slightly round at a radius of about 0.5 mm to about 1.5 mm, for example, about 1.0 mm.

In accordance with some example embodiments, first glue panel 220 may have a pair of angled outer edges 255, 257, which extend from the second side edge 287 of the back panel 218 inward at an angle of about 10 to 30 degrees or about 20 degrees. In accordance with some example embodiments, the second glue panel 238 may have a width of about 50 mm to about 60 mm, for example, about 54.6 mm, and a height of about 14 mm to about 16 mm, for example, about 15.0 mm. The vertical edges 277 of the second glue panel 238 may be angled, for example, angled at about 2.5 to 7.5 degrees or about 5.0 degrees. In addition, the corners 239 of the second glue panel 238 may be rounded at a radius of about 0.5 mm to about 1.5 mm, for example, about 1.0 mm.

In addition, the back panel 218 may have a recess 202 on an upper edge 297 thereof. In accordance with some example embodiments, the recess 202 may have a radius of about 8.0 mm to about 10 mm, for example, about 9.3 mm and a depth of about 6 mm to about 8 mm, for example, about 7 mm. The recess 202 is located in a center portion of the upper edge 297 of the back panel 218 so as to provide an equal distance from the first side edge 285 and the second side edge 287 to a corresponding edge 204 of the recess 202.

In accordance with some example embodiments, the assembled box 110 may have a height of about 105 mm to about 115 mm, for example, about 111.0 mm, a width of about 50 mm to about 60 mm, for example, about 55.0 mm, and a depth of about 16 mm to about 18 mm, for example, about 17.0 mm. In addition, in a flat state, the blank 200 may have a height of 150 mm to about 160 mm, for example, about 156.5 mm, and a width of about 150 mm to about 160 mm, for example, about 155.6 mm. In accordance with some example embodiments, the partially assembled box 200 may be shipped for assembly in a folded and glued format.

Figure 3:
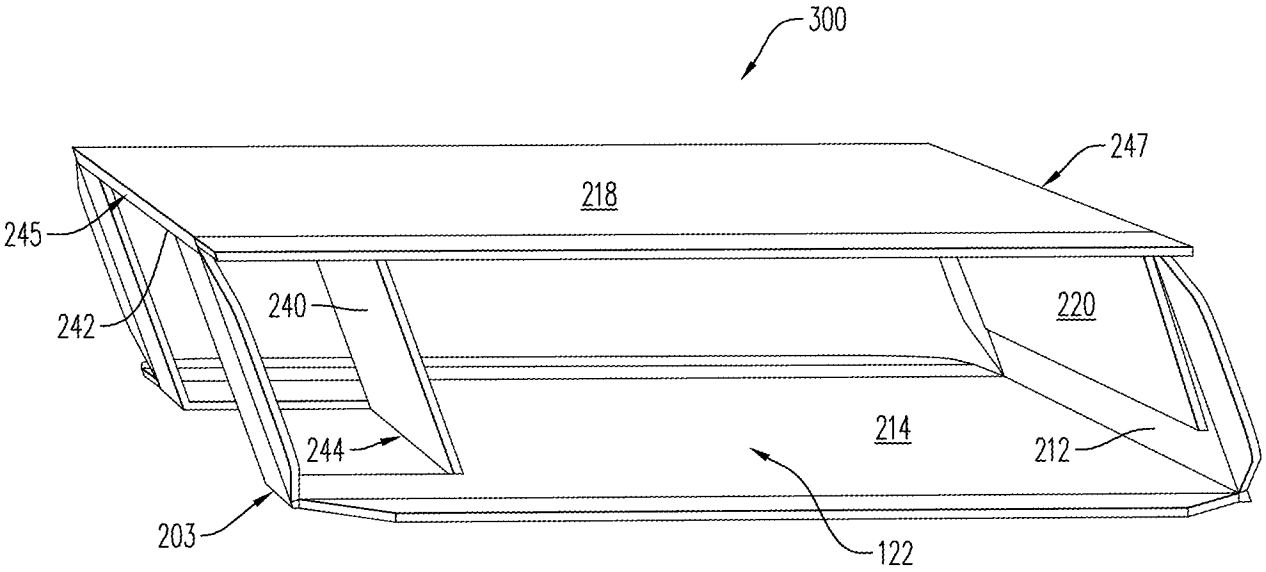
FIG. 3 is a bottom view of a partially erected blank as shown in FIG. 2 in accordance with some example embodiments.

In some example embodiments, as shown in FIG. 3, a resultant box structure 300 from a method for assembling the box 110 from a single laminar blank 200 is provided. In accordance with some example embodiments, the laminar blank 200 is partially folded and glued prior to shipping to a facility for assembly.

In accordance with some example embodiments, as shown in FIG. 3, the fourth fold line 247 is pre-broken or scored and folded 180 degrees. The third fold line 245 is folded 180 degrees, and then the first fold line 241 is folded 180 degrees. The second cavity panel 242, which comprises the area of the cavity side panel 216 between the upper cut line 282 and the lower cut line 284 is glued to an adjacent inside portion (not shown) of the back panel 218. The first glue panel 220 is then glued to a back side of the side panel 212.

In accordance with some example embodiments, the resultant box 300 structure may be flattened to facilitate shipping. The resultant box 300 is supplied by the manufacturer folded and glued as set forth above. In addition, for example, the resultant boxes 300 are not packed tightly so as to flatten them completely.

Figure 4:
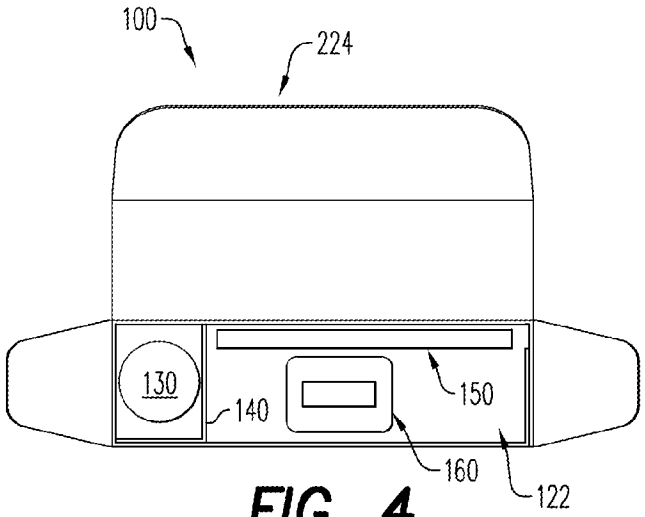
FIG. 4 is a top view of an erected blank as shown in FIG. 2 in accordance with some example embodiments.

FIG. 4 is a top view of an electronic vaping device package 100 as shown in FIG. 1. In accordance with some example embodiments, an instruction booklet 150 and/or a universal serial bus (USB) charger 160 (or other accoutrement of the vaping device) may be placed within the inner cavity 122 of the box 110. In accordance with some example embodiments, the booklet 150 and/or the USB charger 160 within the inner cavity 122 within the rectangular box 110 are not visible to a consumer.

Figure 5:
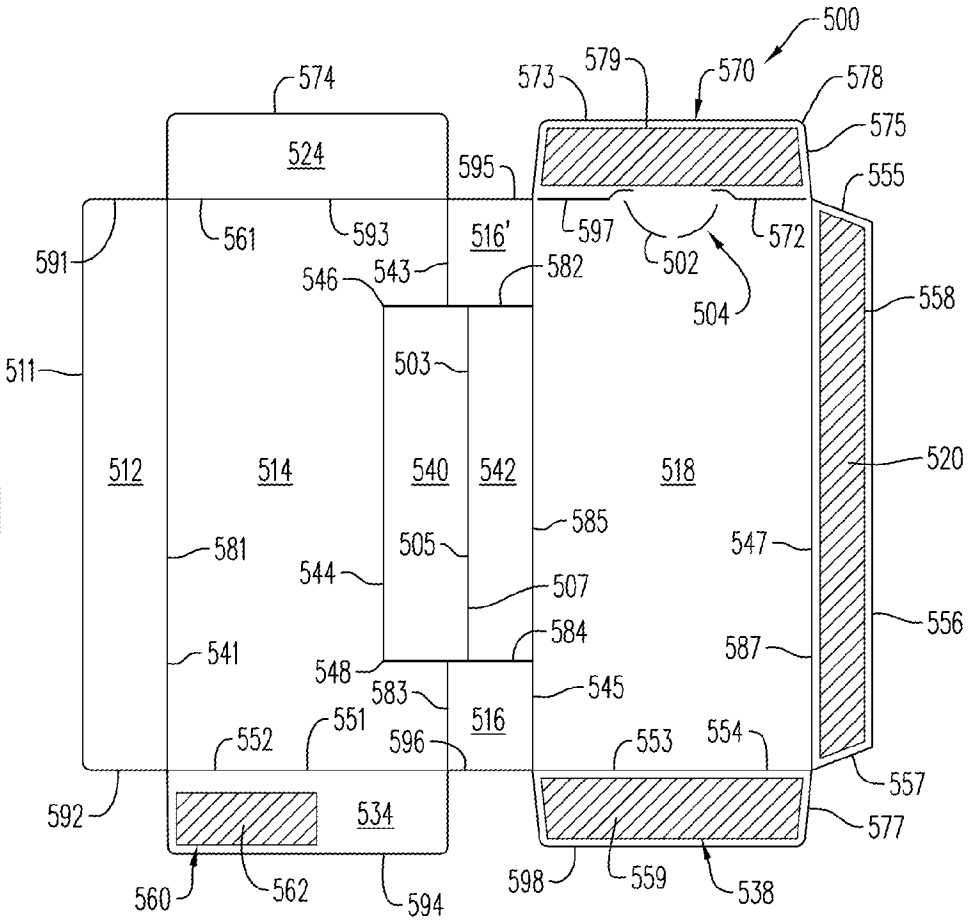
FIG. 5 is a blank for forming an electronic vaping device package in accordance with some example embodiments.

In accordance with some example embodiments, a blank 500 for forming a rectangular box 110 having a cavity 120, which is configured to contain a hollow elongated cylinder 130 is shown in FIG. 5. The blank 500 includes a first complete side panel 512 connected to a front panel 514 along a first fold line 541. The first fold line 541 extends along a first side edge 581 of the front panel 514. Upper and lower cavity side panel portions, 516, 516' (collectively cavity side panel 516) are connected to the front panel 514 along a second fold line 543. The second fold line 543 extends along a second side edge 583 of the front panel 514. A back panel 518 is connected to the cavity side panel 516 along a third fold line 545. The third fold line 545 extends along a first side edge 585 of the back panel 518. A first glue panel 520 connects to the back panel 518 along a fourth fold line 547. The fourth fold line 547 extends along a second side edge 587 of the back panel 518.

The side panel 512 includes a top edge 591 and a lower edge 592. A top panel 524 is connected to the front panel 514 along a fifth fold line 561. The fifth fold line 561 extends along a top edge 593 of the front panel 514. An outer bottom panel 534 is connected to the front panel 514 along a seventh fold line 551. The seventh fold line 551 extends along a bottom edge 552 of the front panel 514.

In accordance with some example embodiments, the back panel 518 may include a third (or top) glue panel 570 and a lower glue panel 538. The third glue panel 570 is connected to the back panel 518 along an eleventh fold line 572, which extends along an upper edge 597 of back panel 518. The second or lower glue panel 538 is connected to the back panel 518 along an eighth fold line 553. The eighth fold line 553 extends along a bottom edge 554 of the back panel 518.

The blank 500 also includes an upper cut line 582 and a lower cut line 584 extending transversely across an upper and a lower portion of the front panel 514 adjacent to the upper and lower side panel portions 516, 516' and extending across the cavity side panel 516, respectively. The upper cut line 582 and the lower cut line 584 form a first cavity panel 540 and a second cavity panel 542 within the front panel 514 and between the side panel portions 516, 516', respectively. A ninth (scored) fold line 544 extends between an inner edge 546 of the upper cut line 582 and an inner edge 548 of the lower cut line 584 on the front panel 514. A tenth (scored) fold line 503 extends between the upper cut line 582 and the lower cut line 584 forming an outer edge 505 of the first cavity panel 540 and an inner edge 507 of the second cavity panel 542.

In accordance with some example embodiments, upon assembly of the box 110, the first cavity panel 540 and the second cavity panel 542 are positioned perpendicular to the front panel 514 and the cavity side panel 516, respectively. Panels 540 and 542 form the viewing window or side cavity 120. In accordance with some example embodiments, the cavity 120 receives the elongated hollow cylinder 130. In accordance with some example embodiments, the upper and lower cut lines 582, 584 extend across the front panel 514 a distance equal to a combined width of the front recess panel 140 and cavity side panel 142 as shown in FIG. 1.

In accordance with some example embodiments, the side panel 512 has a vertical free edge 511. The top panel 524, the bottom panel 534, and the upper glue panel 570, and the bottom glue panel 538, each have a free outer edge 574, 594, 573, 598, respectively. The back panel 518 may include one or more cut lines 504 in a semi-circular shape 502 along and/or in a vicinity of the upper edge 597 of the back panel 518, which provides a tear line, which may assist and/or provide access for a consumer to the contents enclosed within the box 110, which may include the information booklet 150 and/or USB charger 160.

The blank 500 may include a finish or varnish on the clay (printable) side of the blank 500. In accordance with some example embodiments, the first glue panel 520, the bottom panel 534, the second glue panel 538, and the third glue panel 570 may each include a varnish free area or portion 558, 560, 559, 579, respectively, which may improve the bonding formed by the glue, for example, a hot-melt adhesive material, and/or adhesive or pressure sensitive tape 1110 (FIG. 11). In accordance with some example embodiments, the first glue panel 520 has a pair of angled edges 555, 557, which are slightly tapered to a vertical free edge 556. For example, in accordance with some example embodiments, the varnish free areas 558, 579, 559 of the first glue panel 520, the top (or third) glue panel 570, and the bottom (or second) glue panel 520 may cover the entire panels 520, 570, 538.

In accordance with some example embodiments, the varnish free area 560 of the bottom panel 534 may include a date code area 562. The date code area 562 may have a width of about 24 to 28 mm, for example 26 mm, and a height of about 10 to 12 mm, for example 11 mm. In accordance with some example embodiments, the date code area 562 may be positioned about 1.0 to 2.0 mm, for example, 1.5 mm from a left vertical edge and about 1.0 to 2.0 mm, for example, 1.5 mm from a lower free edge of the bottom panel 534.

In accordance with some example embodiments, the side panel 512 may have a width of about 15 mm to about 18 mm, for example, about 16.6 mm, and a height of about 105 mm to about 115 mm, for example, about 109 mm. The front panel 514 may have a width of about 50 mm to about 60 mm, for example, 55 mm and a height of about 105 mm to about 115 mm, for example, about 110 mm. The cavity side panel 516 (portions 516, 516') may have a width of about 16 mm to about 18 mm, for example, 17 mm and a height of about 105 mm to about 15 mm, for example, about 109 mm. The back panel 518 may have a width of about 50 mm to about 60 mm, for example, about 54.6 mm, and a height of about 105 mm to about 115 mm, for example, about 109 mm. The first glue panel 520 may have a width of about 11 mm to about 14 mm, for example, about 12.4 mm, and a height of about 105 mm to about 115 mm, for example, about 109 mm.

In accordance with some example embodiments, the first cavity panel 540 may have a height of about 65 mm to about 75 mm, for example 69 mm, and a width of about 14 mm to about 15 mm, for example, about 14.5 mm. The second cavity panel 542 may have a height of about 65 mm to about 75 mm, for example, 69 mm, and a width of about 13 mm to about 15 mm, for example, about 14 mm. Thus, upon assembly of the package 100, the depth (e.g., about 14.5 mm) of the viewing window or side cavity 120 is greater than a width (14.0 mm) of the viewing window or side cavity 120. In accordance with some example embodiments, a distance from the cut lines 582, 584 to the upper edges 593, 595 of the front panel 514 and the cavity side panel 516, and the lower edges 552, 596 of the front panel 514 and the cavity side panel 516 may be about 19 mm to about 22 mm, for example, about 20.5 mm.

In accordance with some example embodiments, the upper panel 524 may have a width of about 50 mm to about 60 mm, for example, about 55 mm, and a height of about 13 mm to about 15 mm, for example, about 14.0 mm. The bottom panel 534 may have a width of about 50 mm to about 60 mm, for example, about 55 mm and a height of about 13 mm to about 15 mm, for example, about 14.0 mm.

In accordance with some example embodiments, the first glue panel 520 has a pair of angled outer edges 555, 557, which extend from the second side edge 587 of the back panel 518 inward at an angle of about 10 to 30 degrees or about 20 degrees. In accordance with some example embodiments, the second glue panel 538 may have a width of about 50 mm to about 60 mm, for example, about 54.6 mm, and a height of about 12 mm to about 14 mm, for example, about 13.0 mm. The vertical edges 575, 577 of the third glue panel 570 and the second glue panel 538 may be angled, for example, angled at about 2.5 to 7.5 degrees or about 5.0 degrees. In addition, the corners 578, 539 of the third and second glue panels 570, 538 may be rounded at a radius of about 0.5 mm to about 1.5 mm, for example, 1.0 mm.

In addition, the back panel 518 may have one or more cut lines 502 in a circular shape along an upper edge 597. In accordance with some example embodiments, the one or more cut lines 502 may have a radius of about 8.5 mm to about 10 mm, for example, 9.3 mm, and a depth of about 5 mm to about 7 mm, for example, about 5.7 mm. The cut lines 502 may be located at a center portion of the upper edge 597 of the back panel 518 so as to provide an equal distance from the first side edge 585 and the second side edge 587 to a corresponding lower edge 504 of the cut lines 502.

In accordance with some example embodiments, for example, the assembled box 110 may have a height of about 105 mm to about 115 mm, for example, about 110 mm, a width of about 50 mm to about 60 mm, for example, 55 mm, and a depth of about 14 mm to about 16 mm, for example, 15 mm. In addition, in a flat state, the blank 500 may have a height of about 130 mm to about 145 mm, for example, about 138 mm, and a width of about 145 mm to about 155 mm, for example, about 151 mm. In accordance with some example embodiments, the partially assembled box 100 may be shipped for assembly in a folded and glued format.

Figure 6:
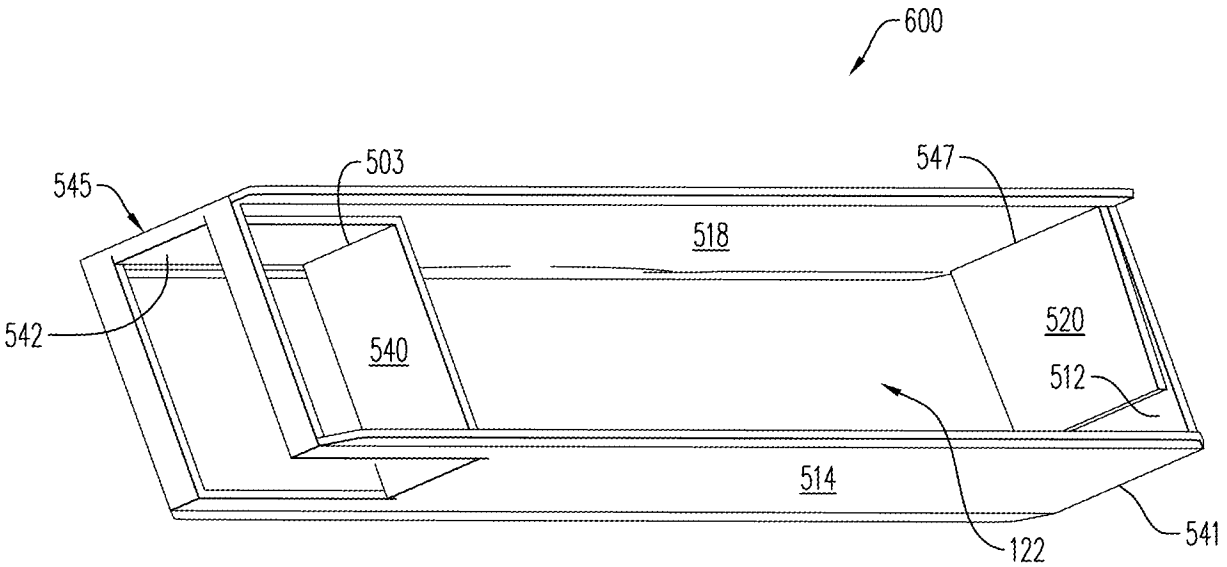
FIG. 6 is a bottom view of a partially erected blank as shown in FIG. 5 in accordance with some example embodiments.

In some example embodiments, as shown in FIG. 6, a resultant box structure 600 from a method for assembling the box 110 from a single laminar blank 500 is provided. In accordance with some example embodiments, the laminar blank 500 is partially folded and glued prior to shipping to a facility for assembly.

In accordance with some example embodiments, the laminar blank 500 is partially folded and glued prior to shipping to a facility for assembly. As shown in FIG. 6, the fourth fold line 547 and the tenth (scored) fold line 503 are pre-broken or scored and folded 180 degrees. The third fold line 545 is folded 180 degrees, and the second cavity panel 542, which comprises the area of the cavity side panel 516 between the upper cut line 582 and the lower cut line 584 is glued to an adjacent inside portion (not shown) of the back panel 518. The first fold line 541 is folded 180 degrees, and the first glue panel 520 is then glued to a back side of the side panel 512.

Figure 7:
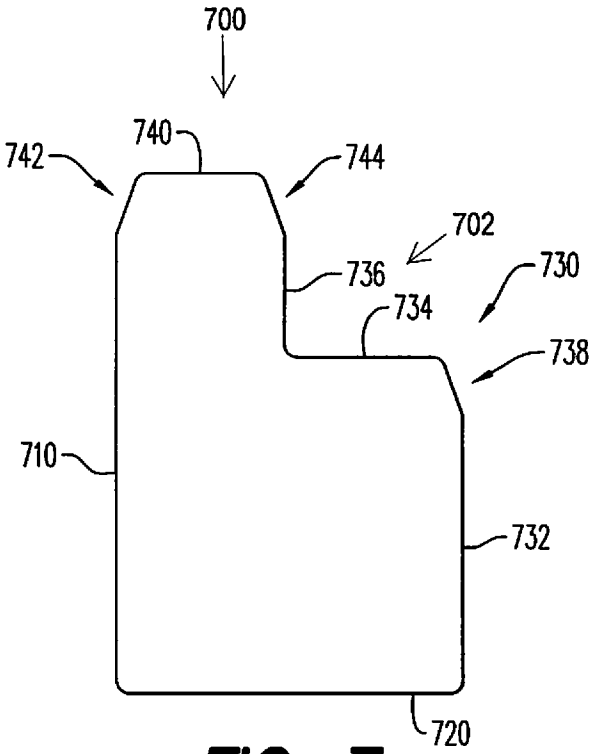
FIG. 7 is a divider panel for an electronic vaping device package in accordance with some example embodiments.

In accordance with some example embodiments, a divider (or divider panel) 700 as shown in FIG. 7, may be positioned within the inner cavity 122 (FIGS. 3, 4, 6, 8, and 13) to assist with positioning, for example, of the USB charger 160 in an upper portion of the inner cavity 122. In accordance with some example embodiments, the divider panel 700 may have a rectangular shape thereto with a recessed panel portion 702 configured to receive, for example, a lower portion of a USB charger 160 so as to retain the USB charger 160 in a fixed position within the inner cavity 122 of the box 110. In accordance with some example embodiments, the divider panel 700 may be folded in half and placed inside the inner cavity 122 of the assembled box 100 to create a cavity configured to receive a lower portion of the USB charger 160.

In accordance with some example embodiments, the divider panel 700 may include a left edge 710, a bottom edge 720, a right edge 730, the right edge having a lower right edge 732, a first top edge 734 extending towards the left edge 732, an upper right edge 736, and a second top edge 740. In accordance with some example embodiments, the top edge 740 has a pair of angled edges, 742, 744, which are at about a 15 degree angle towards one another. A transition edge 738 from the lower right edge 732 to the first top edge 734 may be at about a 15 degree angle.

In some example embodiments, the left and right edges 710, 730 may have a height of about 80 to 90 mm, for example, 85 mm. The bottom edge 720 may have a width of about 40 to 45 mm, for example, 43 mm. The lower edge 732 may have a height of about 50 to 60 mm, for example, 55 mm, and the upper right edge 736 may have a height of about 25 to 35 mm, for example, 30 mm. The first top edge 734 may have a width of about 20 to 25 mm, for example, 22 mm, and the second top edge 740 may have a width of about 20 to 25 mm, for example, 21 mm. In accordance with some example embodiments, the angled edges 742, 744 may have a height of about 10 mm from the second top edge 740.

Figure 8:
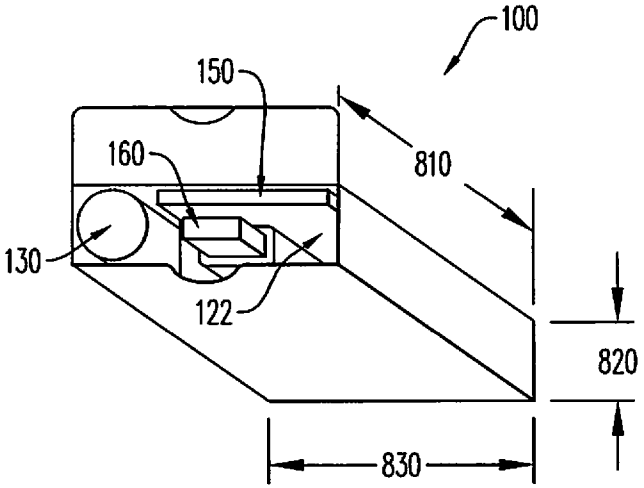
FIG. 8 is a perspective view of an electronic vaping device package in accordance with some example embodiments.

FIG. 8 is a perspective view of an electronic vaping device package 100 formed from a blank as shown in FIGS. 2 and 5. The package 100 may include a tubular or elongated hollow cylinder (or body) 130, an instruction booklet (or information packet) 150, and a USB charger 160. The instruction booklet (or information packet) 150 and the USB charger 160 may be contained within the inner cavity 122 of the package 100. In accordance with some example embodiments, the package 100 may have a height 810 of about 105 to 115 mm, for example, 110 mm, a width 820 of about 10 to 20 mm, for example, 15 mm, and a length 830 of about 50 to 60 mm, for example, about 55 mm.

In accordance with some example embodiments, a lower portion of the USB charger 160 is configured to rest on the upper right edge 736 of the divider panel 700 upon folding the divider panel 700 and placing the panel 700 within the inner cavity 122.

Figure 9:
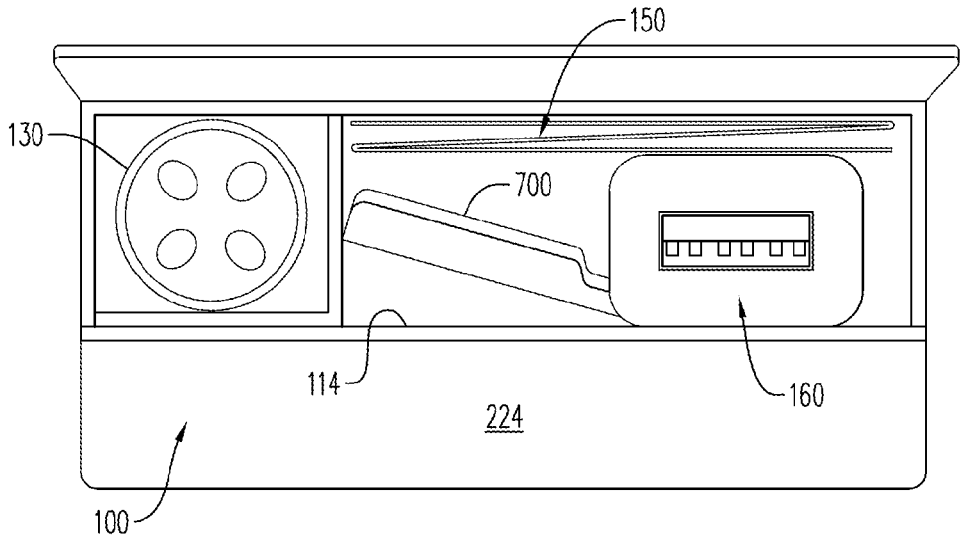
FIG. 9 is an end view of an erected blank in accordance with some example embodiments.

FIG. 9 is an end view of an electronic vaping device package 100 as shown in FIG. 1. As shown in FIG. 9, the divider 700 extends diagonally from an inner surface of the front recess panel 140 across to an inner surface of the side panel 112 on a side opposite thereof. In accordance with some example embodiments, an instruction booklet and/or coupons 150 and/or a USB charger 160 may be placed within the inner cavity 122 of the box 110. For example, in accordance with some example embodiments, the inner cavity 122 may include an eight panel information insert and a two panel coupon 150.

Figure 10:
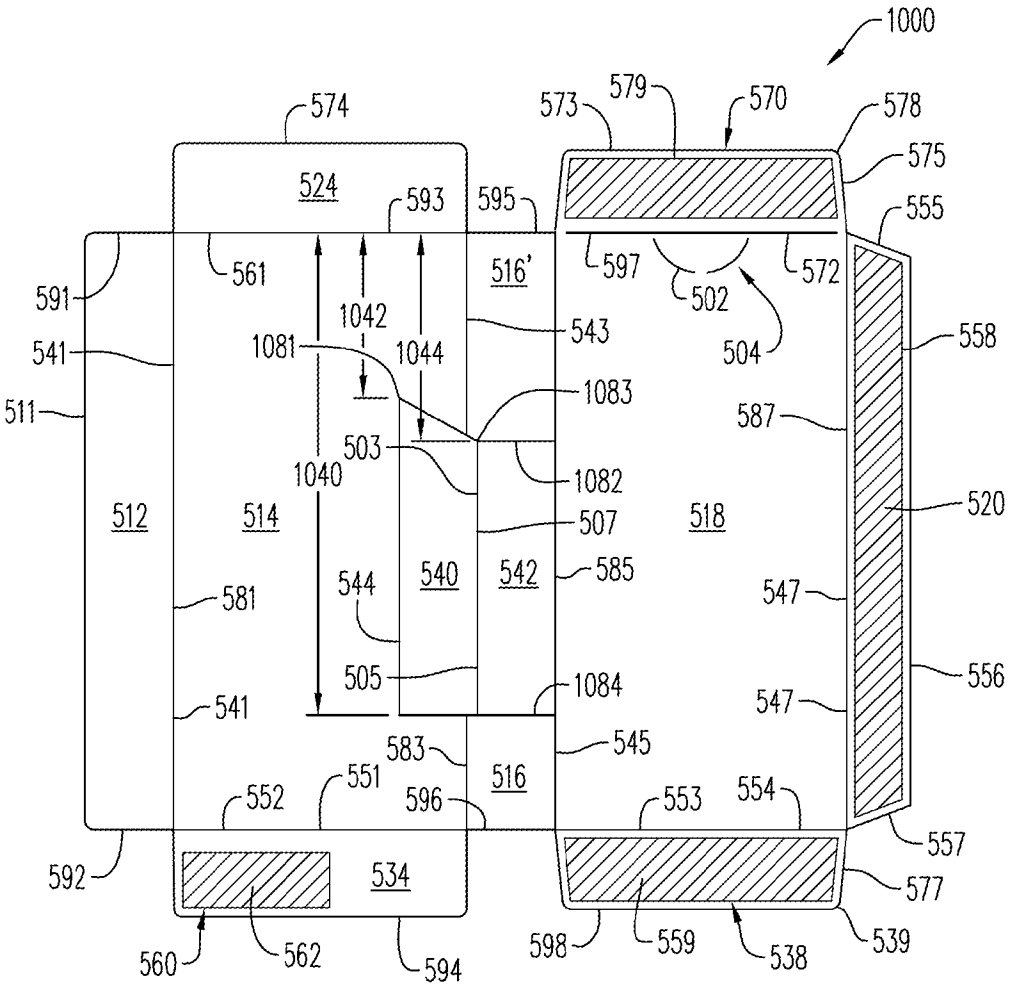
FIG. 10 is a blank for forming an electronic vaping device package in accordance with some example embodiments.

FIG. 10 is a blank 1000 for forming a rectangular box 110 having a cavity 120, which is configured to contain a hollow elongated cylinder 130. The blank 1000 is similar to the blank as shown in FIG. 5, and includes a first complete side panel 512 connected to a front panel 514 along a first fold line 541. The first fold line 541 extends along a first side edge 581 of the front panel 514. Upper and lower cavity side panel portions, 516, 516' (collectively cavity side panel 516) are connected to the front panel 514 along a second fold line 543. The second fold line 543 extends along a second side edge 583 of the front panel 514. A back panel 518 is connected to the cavity side panel 516 along a third fold line 545. The third fold line 545 extends along a first side edge 585 of the back panel 518. A first glue panel 520 connects to the back panel 518 along a fourth fold line 547. The fourth fold line 547 extends along a second side edge 587 of the back panel 518.

The side panel 512 includes a top edge 591 and a lower edge 592. A top panel 524 is connected to the front panel 514 along a fifth fold line 561. The fifth fold line 561 extends along a top edge 593 of the front panel 514. An outer bottom panel 534 is connected to the front panel 514 along a seventh fold line 551. The seventh fold line 551 extends along a bottom edge 552 of the front panel 514.

In accordance with some example embodiments, the back panel 518 may include a third (or top) glue panel 570 and a lower glue panel 538. The third glue panel 570 is connected to the back panel 518 along an eleventh fold line 572, which extends along an upper edge 597 of back panel 518. The second or lower glue panel 538 is connected to the back panel 518 along an eighth fold line 553. The eighth fold line 553 extends along a bottom edge 554 of the back panel 518.

The blank 500 also includes an upper cut line 1082 and a lower cut line 1084 extending transversely across an upper and a lower portion of the front panel 514 adjacent to the upper and lower side panel portions 516, 516' and extending across the cavity side panel 516, respectively. The upper cut line 1082 and the lower cut line 1084 form a first cavity panel 540 and a second cavity panel 542 within the front panel 514 and between the side panel portions 516, 516', respectively. A ninth (scored) fold line 544 extends between an inner edge 546 of the upper cut line 582 and an inner edge 548 of the lower cut line 584 on the front panel 514. A tenth (scored) fold line 503 extends between the upper cut line 582 and the lower cut line 584 forming an outer edge 505 of the first cavity panel 540 and an inner edge 507 of the second cavity panel 542.

In accordance with some example embodiments, the upper cut line 1082 extends from an upper edge of the ninth fold line 544 and is angled downwards toward the tenth fold line 544 and then extends horizontally from the tenth fold line 544 to the first side edge 585 of the back panel 518.

As shown in FIG. 10, the ninth fold line 544 may have a length of about 59.5 mm, and wherein a distance 1040 from a lower edge of the ninth fold line 544 to the fifth fold line 561 may be about 80 to about 90, for example, 89.5 mm. In accordance with some example embodiments, a distance 1042 from an upper edge 1081 of the upper cut line 1082 to the fifth fold line 561 may be about 25 to about 35 mm, for example, 30 mm, and a distance 1044 from a lower edge 1083 of the upper cut line 1082 to the fifth fold line 561 may be about 30 to 45 mm, for example, 38 mm In accordance with some example embodiments, upon assembly of the box 110, the first cavity panel 540 and the second cavity panel 542 are positioned perpendicular to the front panel 514 and the cavity side panel 516, respectively. Panels 540, 542 form the viewing window or side cavity 120. In accordance with some example embodiments, the cavity 120 receives the elongated hollow cylinder 130. In accordance with some example embodiments, the upper and lower cut lines 582, 584 extend across the front panel 514 a distance equal to a combined width of the front recess panel 140 and cavity side panel 142 as shown in FIG. 1.

In accordance with some example embodiments, the side panel 512 has a vertical free edge 511. The top panel 524, the bottom panel 534, the upper glue panel 570, and the bottom glue panel 538, each have a free outer edge 574, 594, 573, 598, respectively. The back panel 518 may include one or more cut lines 504 in a semi-circular shape 502 along and/or in a vicinity of the upper edge 597 of the back panel 518, which provides a tear line, which may assist and/or provide access for a consumer to the contents enclosed within the box 110, which may include the information booklet 150 and/or USB charger 160.

The blank 500 may include a finish or varnish on the clay (printable) side of the blank 500. In accordance with some example embodiments, the first glue panel 520, the bottom panel 534, the second glue panel 538, and the third glue panel 570 may each include a varnish free area or portion 558, 560, 559, 579, respectively, which may improve the bonding formed by the glue, for example, a hot-melt adhesive material, and/or an adhesive or pressure sensitive tape 1110 (FIG. 11). In accordance with some example embodiments, the first glue panel 520 has a pair of angled edges 555, 557, which are slightly tapered to a vertical free edge 556. For example, in accordance with some example embodiments, the varnish free areas 558, 579, 559 of the first glue panel 520, the top (or third) glue panel 570, and the bottom (or second) glue panel 538 may cover the entire panels 520, 570, 538.

In accordance with some example embodiments, the varnish free area 560 of the bottom panel 534 may include a date code area 562. The date code area 562 may have a width of about 24 to 28 mm, for example 26 mm, and a height of about 10 to 12 mm, for example 11 mm. In accordance with some example embodiments, the date code area 562 may be positioned about 1.0 to 2.0 mm, for example, 1.5 mm from a left vertical edge and about 1.0 to 2.0 mm, for example, 1.5 mm from a lower free edge of the bottom panel 534.

In accordance with some example embodiments, the side panel 512 may have a width of about 15 mm to about 18 mm, for example, about 16.6 mm, and a height of about 105 mm to about 115 mm, for example, about 109 mm. The front panel 514 may have a width of about 50 mm to about 60 mm, for example, 55 mm and a height of about 105 mm to about 115 mm, for example, about 110 mm. The cavity side panel 516 (portions 516, 516') may have a width of about 16 mm to about 18 mm, for example, 17 mm and a height of about 105 mm to about 15 mm, for example, about 109 mm. The back panel 518 may have a width of about 50 mm to about 60 mm, for example, about 54.6 mm, and a height of about 105 mm to about 115 mm, for example, about 109 mm. The first glue panel 520 may have a width of about 11 mm to about 14 mm, for example, about 12.4 mm, and a height of about 105 mm to about 115 mm, for example, about 109 mm.

In accordance with some example embodiments, the first cavity panel 540 may have a height of about 65 mm to about 75 mm, for example 69 mm, and a width of about 14 mm to about 15 mm, for example, about 14.5 mm. The second cavity panel 542 may have a height of about 65 mm to about 75 mm, for example, 69 mm, and a width of about 13 mm to about 15 mm, for example, about 14 mm. Thus, upon assembly of the package 100, the depth (e.g., about 14.5 mm) of the viewing window or side cavity 120 is greater than a width (14.0 mm) of the viewing window or side cavity 120. In accordance with some example embodiments, a distance from the cut lines 582, 584 to the upper edges 593, 595 of the front panel 514 and the cavity side panel 516, and the lower edges 552, 596 of the front panel 514 and the cavity side panel 516 may be about 19 mm to about 22 mm, for example, about 20.5 mm.

In accordance with some example embodiments, the upper panel 524 may have a width of about 50 mm to about 60 mm, for example, about 55 mm, and a height of about 13 mm to about 15 mm, for example, about 14.0 mm. The bottom panel 534 may have a width of about 50 mm to about 60 mm, for example, about 55 mm and a height of about 13 mm to about 15 mm, for example, about 14.0 mm.

In accordance with some example embodiments, the first glue panel 520 has a pair of angled outer edges 555, 557, which extend from the second side edge 587 of the back panel 518 inward at an angle of about 10 to 30 degrees or about 20 degrees. In accordance with some example embodiments, the second glue panel 538 may have a width of about 50 mm to about 60 mm, for example, about 54.6 mm, and a height of about 12 mm to about 14 mm, for example, about 13.0 mm. The vertical edges 575, 577 of the third glue panel 570 and the second glue panel 538 may be angled, for example, angled at about 2.5 to 7.5 degrees or about 5.0 degrees. In addition, the corners 578, 539 of the third and second glue panels 570, 538 may be rounded at a radius of about 0.5 mm to about 1.5 mm, for example, 1.0 mm.

In addition, the back panel 518 may have one or more cut lines 502 in a generally circular shape along an upper edge 597. In accordance with some example embodiments, the one or more cut lines 502 may have a radius of about 8.5 mm to about 10 mm, for example, 9.3 mm, and a depth of about 5 mm to about 7 mm, for example, about 5.7 mm. The cut lines 502 may be located in a center portion of the upper edge 597 of the back panel 518 so as to provide an equal distance from the first side edge 585 and the second side edge 587 to a corresponding lower edge 504 of the cut lines 502.

In accordance with some example embodiments, for example, the assembled box 110 may have a height of about 105 mm to about 115 mm, for example, about 110 mm, a width of about 50 mm to about 60 mm, for example, 55 mm, and a depth of about 14 mm to about 16 mm, for example, 15 mm. In addition, in a flat state, the blank 500 may have a height of about 130 mm to about 145 mm, for example, about 138 mm, and a width of about 145 mm to about 155 mm, for example, about 151 mm. In accordance with some example embodiments, the partially assembled box 100 may be shipped for assembly in a folded and glued format.

FIG. 11 is a blank for forming 1100 an electronic vaping device package in accordance with some example embodiments. As shown in FIG. 11, the blank 1100 is similar to the blank 1000 as shown in FIG. 10 with the exception that the top panel 524, which is connected to the front panel 514 along a fifth fold line 561 and the outer bottom panel 534, which is connected to the front panel 514 along a seventh fold line 551 may include a pressure sensitive tape 1110. The pressure sensitive tape 1110 may be attached to the backside of the top panel 524 and bottom panel 534. For example, in accordance with some example embodiments, the pressure sensitive tape 1110 may have a width of about 35 mm to 45 mm, for example, 40 mm to 41 mm, and a height of about 8 mm to 12 mm. In accordance with some example embodiments, the pressure sensitive tape 1110 may be place within about 1 mm to 2 mm, for example, 1 mm of the upper free edge 574 or the lower free edge 594 of the top and bottom panels, 524, 534. For example, the pressure sensitive tape 1110 may be a pressure sensitive tape manufactured by 3M, such as 3M Extended Liner Tape 476XL, 0.5 (½) inch wide liner 1112, and 0.25 (¼) inch adhesive 1114

Figure 12:
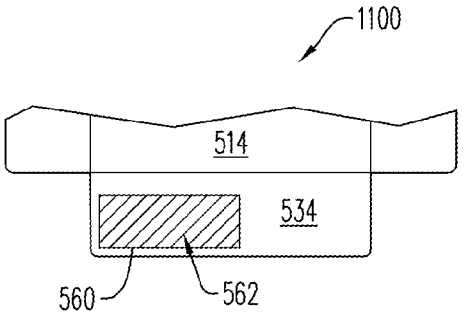
FIG. 12 is a partial view of the blank as shown in FIG. 11 for forming an electronic vaping device package in accordance with some example embodiments.

FIG. 12 is a partial view of the blank 1110 as shown in FIG. 11 for forming an electronic vaping device package in accordance with some example embodiments. As shown in FIG. 12, the front side of the blank 1110 may include a varnish free area 560 on the bottom panel 534, which may include a date code area 562. The date code area 562 may have a width of about 24 mm to about 28 mm, for example 26 mm, and a height of about 10 mm to about 12 mm, for example 11 mm. In accordance with some example embodiments, the date code area 262 may be positioned about 1.0 mm to about 2.0 mm, for example, about 1.5 mm from a left vertical edge and about 1.0 mm to 2.0 mm, for example, 1.5 mm from a lower free edge 594 of the bottom panel 534.

Figure 13:
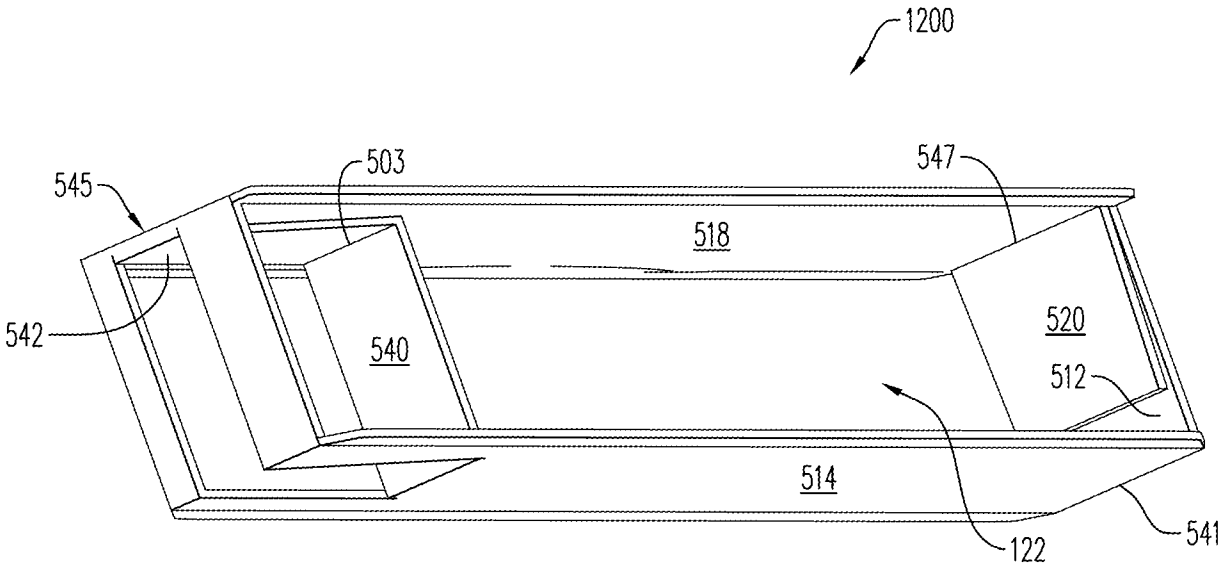
FIG. 13 is a bottom view of a partially erected blank as shown in FIGS. 10 and 11 in accordance with some example embodiments.

FIG. 13 is a bottom view of a resultant box structure 1200 from partially erected blanks 1000, 1100 as shown in FIGS. 10 and 11. In accordance with some example embodiments, the laminar blanks 1000, 1100 are partially folded and glued prior to shipping to a facility for assembly. As shown in FIG. 13, the fourth fold line 547 and the tenth (scored) fold line 503 are pre-broken or scored and folded 180 degrees. The third fold line 545 is folded 180 degrees, and the second cavity panel 542, which comprises the area of the cavity side panel 516 between the upper cut line 582 and the lower cut line 584 is glued to an adjacent inside portion (not shown) of the back panel 518. The first fold line 541 is folded 180 degrees, and the first glue panel 520 is then glued to a back side of the side panel 512.

In accordance with some example embodiments, the blanks 200, 500, 1000, 1100 may be formed of a material selected from the group consisting of cardboard, paperboard, plastic, metal, or combinations thereof. For example, the blank 200, 500, 1000, 1100 is formed of cardboard having a weight ranging from about 100 grams per square meter to about 350 grams per square meter. In FIGS. 2, 5, 10, and 11, the clay coated side of the blank 200, 500, 1000, 1100 is shown.

In accordance with some example embodiments, the blank 200, 500, 1000, 1100 includes one or more of printing, embossing, debossing, embellishments and combinations thereof on an outer surface of the blank 200, 500, 1000, 1100.

In some example embodiments, the blank 200, 500, 1000, 1100 may be formed from any suitable materials including, but not limited to, cardboard, paperboard, plastic, metal, or combinations thereof. The blank 200, 500, 1000, 1100 is formed from one or more folded laminar cardboard blanks. Also, the cardboard has a weight ranging from about 100 grams per square meter (gsm) to about 350 grams per square meter.

In some example embodiments, exterior surfaces of the box 110 may be printed, embossed, debossed or otherwise embellished with manufacturer or brand logos, trademarks, slogans and other consumer information and indicia.

In accordance with some example embodiments, the fold and/or score lines are 2 pt. rule.

As used herein, the term "longitudinal" refers to a direction from bottom to top or vice versa of the box 110. The term "transverse" refers to a direction perpendicular to the longitudinal direction.

In accordance with the above-described example embodiments of the present disclosure, a fold line may be any substantially linear, although not necessarily straight, form of weakening that facilitates folding therealong. More specifically, but not for the purpose of narrowing the scope of the present disclosure, fold lines include a score line, such as lines formed with a blunt scoring knife, or the like, which creates a crushed portion in the material along the desired line of weakness. In addition, cut line extends partially into and/or completely through the material along the desired line of weakness so as to separate one portion of a panel or panels from another portion of a panel or panels.

It will now be apparent to those skilled in the art that the foregoing specification describes with particularity a box. Moreover, it will also be apparent to those skilled in the art that various modifications, substitutions, variations, and equivalents exist for claimed features of container. Accordingly, it is expressly intended that all such modifications, substitutions, variations, and equivalents for claimed features of the container, which fall within the spirit and scope of the invention as defined by the appended claims, be embraced thereby.

What is claimed is:

1. A package configured to display a selected portion of an article, the package comprising:

a box structure having a side portion, the side portion divided into a lower retention portion, an upper retention portion, and a window recess portion, the recess portion disposed between the upper retention portion and the lower retention portion;

the recess portion including a side recess panel at a location along a side panel of the box structure and a front recess panel along a front panel of the box structure, the front recess panel adjacent the side recess panel, the front recess panel having a greater width than the side recess panel such that the window recess portion has a greater depth than width, the first and front recess panels being folded into the box structure, and the window recess portion, the upper retention portion, and the lower retention portion being mutually arranged to retain the article along the side portion, with a portion of the article being displayed along the recess portion, wherein the side recess panel is adhesively bonded to an adjacent portion of a back panel of the box structure using a first adhesive;

a USB charger within an inner cavity within the rectangular box portion, and wherein the inner cavity is not visible to a consumer; and a rectangular shaped insertable divider configured to be inserted longitudinally into an end of the inner cavity to be positioned diagonally within the inner cavity, the divider having an upper right edge and a first top edge that defines a recess, the first top edge being configured to support a lower portion of the USB charger such that the USB charger is located within an upper portion of the inner cavity upon opening of the box structure.

2. The package of claim 1, wherein the retention portions block selected portions of the article from view.

3. The package of claim 1, further comprising:

a tubular body configured to visibly contain the article; and a booklet within the inner cavity.

4. The package of claim 1, wherein the box structure is erected from a blank, the blank comprising:

the side panel connected to the front panel along a first fold line, the first fold line extending along a first side edge of the front panel;

a cavity side panel connected to the front panel along a second fold line, the second fold line extending along a second side edge of the front panel;

the back panel connected to the cavity side panel along a third fold line, the third fold line extending along a first side edge of the back panel;

a first glue panel connected to the back panel along a fourth fold line, the fourth fold line extending along a second side edge of the back panel;

a top panel connected to the front panel along a fifth fold line, the fifth fold line extending along a top edge of the front panel, the top panel having a upper flap panel and an end panel, and wherein the upper flap panel is connected to the end panel along a sixth fold line;

a bottom panel connected to the front panel along a seventh fold line, the seventh fold line extending along a bottom edge of the front panel;

a second glue panel connected to the back panel along an eighth fold line, the eighth fold line extending along a bottom edge of the back panel, the second glue panel having a second adhesive on the second glue panel that is configured to seal a lower end of the box structure;

a first upper dust panel connected to the side panel along a top edge of the side panel;

a first lower dust panel connected to the side panel along a lower edge of the side panel;

a second upper dust panel connected to the cavity side panel along a top edge of the cavity side panel;

a second lower dust panel connected to the cavity side panel along a lower edge of the cavity side panel; and an upper and a lower cut line extending across an upper and a lower portion of the front panel adjacent to the cavity side panel and extending across the cavity side panel, respectively, and which forms the front recess panel and the side recess panel, such that upon assembly of the box structure, the front recess panel and the side recess panel are perpendicular to the front panel and the cavity side panel, respectively, in order to form the side portion which is configured to retain the article.

5. The package of claim 4, wherein the blank further includes, a ninth fold line connecting an inner edge of the upper cut line and an inner edge of the lower cut line on the front panel; and a tenth fold line extending between the upper cut line and the lower cut line forming an outer edge of the front recess panel and an inner edge of the side recess panel, the tenth fold line not being aligned with the second fold line.

6. The package of claim 4, wherein the blank further includes, a varnish free area on the bottom panel configured to include a date code area.

7. The package of claim 4, wherein the blank further includes, a recess within an upper edge of the back panel.

8. The package of claim 4, wherein each of the first upper and lower dust panels and the second upper and lower dust panels of the blank has an outer edge with a slightly recessed portion, and wherein the outer edge faces is opposite side of the front panel.

9. The package of claim 4, wherein the blank is formed of a material selected from the group consisting of cardboard, paperboard, plastic, metal, or combinations thereof.

10. The package of claim 1, wherein the box structure is erected from a blank, the blank comprising:

the side panel connected to the front panel along a first fold line, the first fold line extending along a first side edge of the front panel;

a cavity side panel connected to the front panel along a second fold line, the second fold line extending along a second side edge of the front panel;

the back panel connected to the cavity side panel along a third fold line, the third fold line extending along a first side edge of the back panel;

a first glue panel connected to the back panel along a fourth fold line, the fourth fold line extending along a second side edge of the back panel;

a top panel connected to the front panel along a fifth fold line, the fifth fold line extending along a top edge of the front panel;

a bottom panel connected to the front panel along a sixth fold line, the sixth fold line extending along a bottom edge of the front panel;

a second glue panel connected to the back panel along an seventh fold line, the seventh fold line extending along a bottom edge of the back panel;

a first upper dust panel connected to the side panel along a top edge of the side panel;

a third glue panel connected to the back panel along an eighth fold line, which extends along an upper edge of the back panel; and an upper and a lower cut line extending across an upper and a lower portion of the front panel adjacent to the cavity side panel and extending across the cavity side panel, respectively, and which forms the front recess panel and the side recess panel, such that upon assembly of the box structure, the front recess panel and the side recess panel are perpendicular to the front panel and the cavity side panel, respectively, in order to form the side portion which is configured to retain the article.

11. The package of claim 10, wherein the blank further includes, a ninth fold line connecting an inner edge of the upper cut line and an inner edge of the lower cut line on the front panel; and a tenth fold line extending between the upper cut line and the lower cut line forming an outer edge of the front recess panel and an inner edge of the side recess panel, the tenth fold line not being aligned with the second fold line.

12. The package of claim 11, wherein the upper cut line of the blank is angled downwards from an upper edge of the ninth fold line to the tenth fold line and extends horizontally from the tenth fold line to the first side edge of the back panel.

13. The package of claim 10, wherein the blank further includes, one or more cut lines extending from the upper edge of the back panel in a semi-circular shape.

14. The package of claim 10, wherein the blank further includes, a varnish free area on the bottom panel configured to include a date code area.

15. The package of claim 1, wherein the insertable divider further includes, a left edge adjacent to the first top edge of the insertable divider, a beveled transition edge connecting the first top edge to the left edge, and a second top edge on a top most edge of the insertable divider, the second top edge having two corner edges, each of the two corner edges being beveled edges.

16. The package of claim 15, wherein the insertable divider is made from a single web of material that is folded in half to remain free-floating within the inner cavity, the beveled transition edge and the two corner edges of the insertable divider being angled at about 15 degrees relative to a longitudinal length of the insertable divider.

17. The package of claim 4, wherein the first glue panel has a third adhesive on an upper surface of the first glue panel in order to adhesively bond the upper surface of the first glue panel to a rear surface of the side panel, the second adhesive being on an upper surface of the second glue panel.

18. The package of claim 3, wherein the package is made from a singular web of material that is foldable in order to assemble the package and visibly contain the tubular body.

19. A package configured to display a selected portion of an article, the package comprising:

a box structure having a side portion, the side portion divided into a lower retention portion, an upper retention portion, and a window recess portion, the recess portion disposed between the upper retention portion and the lower retention portion;

the recess portion including a side recess panel at a location along a side panel of the box structure and a front recess panel along a front panel of the box structure, the front recess panel adjacent the side recess panel, the front recess panel having a greater width than the side recess panel such that the window recess portion has a greater depth than width, the first and front recess panels being folded into the box structure, and the window recess portion, the upper retention portion, and the lower retention portion being mutually arranged to retain the article along the side portion, with a portion of the article being displayed along the recess portion, wherein the side recess panel is adhesively bonded to an adjacent portion of a back panel of the box structure using a first adhesive, wherein the box structure is erected from a blank, the blank including, the side panel connected to the front panel along a first fold line, the first fold line extending along a first side edge of the front panel, a cavity side panel connected to the front panel along a second fold line, the second fold line extending along a second side edge of the front panel, the back panel connected to the cavity side panel along a third fold line, the third fold line extending along a first side edge of the back panel, a first glue panel connected to the back panel along a fourth fold line, the fourth fold line extending along a second side edge of the back panel, a top panel connected to the front panel along a fifth fold line, the fifth fold line extending along a top edge of the front panel, the top panel having a upper flap panel and an end panel, and wherein the upper flap panel is connected to the end panel along a sixth fold line, a bottom panel connected to the front panel along a seventh fold line, the seventh fold line extending along a bottom edge of the front panel, a second glue panel connected to the back panel along an eighth fold line, the eighth fold line extending along a bottom edge of the back panel, the second glue panel having a second adhesive on the second glue panel that is configured to seal a lower end of the box structure, a first upper dust panel connected to the side panel along a top edge of the side panel, a first lower dust panel connected to the side panel along a lower edge of the side panel, a second upper dust panel connected to the cavity side panel along a top edge of the cavity side panel, a second lower dust panel connected to the cavity side panel along a lower edge of the cavity side panel, an upper and a lower cut line extending across an upper and a lower portion of the front panel adjacent to the cavity side panel and extending across the cavity side panel, respectively, and which forms the front recess panel and the side recess panel, such that upon assembly of the box structure, the front recess panel and the side recess panel are perpendicular to the front panel and the cavity side panel, respectively, in order to form the side portion which is configured to retain the article, the cavity side panel including an upper cavity side panel above the side recess panel and a lower cavity side panel below the side recess panel, the upper cut line including a first upper cut line and a second upper cut line, the first upper cut line extending horizontally along at least a first portion of a first interface between the upper cavity side panel and the side recess panel, and the second upper cut line extending diagonally along a second interface between an upper edge of the front recess panel and an upper portion of the front panel, and the second portion of the upper cut line also extending along at least a second portion of the first interface between the upper cavity side panel and the side recess panel, the second portion of the upper cut line defining a beveled corner on a lower corner of the upper cavity side panel, the lower corner being adjacent to the front recess panel.

20. The package of claim 19, wherein an upper edge of the second portion of the upper cut line extends toward the top edge of the front panel, an upper-most edge of the second portion of the upper cut line being between about 20% and 45% closer to the top edge of the front panel relative to a lower-most edge of the second portion of the upper cut line, the upper-most edge of the second portion of the upper cut line terminating at the ninth fold line.

* * * * *